US005987816A

United States Patent [19]

Fischer et al.

[11] Patent Number: 5,987,816

[45] Date of Patent: Nov. 23, 1999

[54] GATE ANCHOR AND SYSTEM AND METHOD OF LOCKING A GATE

[75] Inventors: Kenneth C. Fischer, Burnt Hills; Kevin E. Higgins, South Glens Falls, both of N.Y.

[73] Assignee: The Tymetal Corporation, Schuylerville, N.Y.

[21] Appl. No.: 09/032,556

[22] Filed: Feb. 27, 1998

Related U.S. Application Data

[63] Continuation-in-part of application No. 08/686,119, Jul. 23, 1996, Pat. No. 5,740,629.

[51] Int. Cl.[6] ..... E01F 13/00

[52] U.S. Cl. ..... 49/9; 404/6

[58] Field of Search ..... 49/9, 394; 256/73, 256/13.1, 1; 292/333; 404/6, 9

[56] References Cited

U.S. PATENT DOCUMENTS

| | | |
|---|---|---|
| 321,184 | 5/1885 | Brady . |
| 326,922 | 9/1885 | Scherer . |
| 353,481 | 11/1886 | Copeland . |
| 507,717 | 10/1893 | Neutascher . |
| 564,388 | 7/1896 | Merritt . |
| 1,126,728 | 2/1915 | Dillabough . |
| 1,231,763 | 7/1917 | Loprete . |
| 1,692,425 | 11/1928 | Strauss . |
| 1,844,767 | 2/1932 | Kelly . |
| 2,023,538 | 10/1935 | Orr et al. . |
| 2,189,974 | 2/1940 | Buford . |
| 2,373,783 | 4/1945 | Schlifer . |
| 2,602,249 | 7/1952 | Sawyer . |
| 2,746,745 | 5/1956 | Damon . |
| 3,394,497 | 7/1968 | Case . |
| 3,531,895 | 10/1970 | Appell . |
| 3,708,192 | 1/1973 | Klebba et al. . |
| 3,775,906 | 12/1973 | Dougherty . |
| 3,871,134 | 3/1975 | Lening . |
| 4,065,878 | 1/1978 | Tsugane . |
| 4,313,281 | 2/1982 | Richmond . |
| 4,791,757 | 12/1988 | Orlando . |
| 4,818,137 | 4/1989 | Gorlov . |
| 4,844,653 | 7/1989 | Dickinson . |
| 4,916,859 | 4/1990 | Butler . |
| 5,452,544 | 9/1995 | Weathington, Sr. . |
| 5,499,517 | 3/1996 | McCraw . |
| 5,740,629 | 4/1998 | Fischer et al. ..... 49/9 |

*Primary Examiner*—Daniel P. Stodola
*Assistant Examiner*—Curtis Cohen
*Attorney, Agent, or Firm*—Schmeiser, Olsen & Watts

[57] ABSTRACT

A fortified gate system and locking mechanism which utilizes spring loaded locking mechanisms, triggered by the impact of an object such as a vehicle, to interlock a gate, a brace, and fortified anchoring devices. This interconnected structure forms an energy absorbing, impenetrable barrier. Because the gate system functions as a normal gate until an instance of attempted crashing entry, it provides reasonable accessibility while maintaining a high level of security. The present device also includes a gate anchor and locking system which is operable independent of the direction in which the gate is impacted.

47 Claims, 7 Drawing Sheets

GATE ANCHOR AND SYSTEM AND METHOD OF LOCKING A GATE

This application is a continuation-in-part of patent application Ser. No. 08/686,119, filed Jul. 23, 1996, now U.S. Pat. No. 5,740,629. That prior application is hereby incorporated by reference.

BACKGROUND OF THE INVENTION

1. Field of the Invention

The present invention relates generally to barriers. More particularly, the present invention relates to fortified security gates intended to withstand vehicular impacts and a method of locking the fortified security gates.

2. Related Art

Gates used in secured areas such as prisons, airports, power plants, government facilities, research facilities, etc., must provide accessibility without diminishing security. Because of this need for accessibility, gates are often difficult to fortify or reinforce and may constitute a vulnerable spot in a perimeter security system where high powered or high speed vehicles may gain entry by impacting and knocking down the gates.

Several gates have been developed to waylay or stop vehicles attempting encroachment, thus preventing unauthorized entry into secured areas or onto barricaded portions of highway or railroad tracks. Among these are Strauss (U.S. Pat. No. 1,692,425), Orr (U.S. Pat. No. 2,023,538), Sawyer (U.S. Pat. No. 2,602,249), Buford (U.S. Pat. No. 2,189,974), and Butler (U.S. Pat. No. 4,916,859).

U.S. Pat. No. 1,692,425 to Strauss discloses a device for stopping high powered vehicles. This invention includes a liftable barrier that spans a roadway. The barrier raises vertically and remains suspended above the roadway when not in use. Furthermore, the barrier pays out when struck by a vehicle, and has a device for preventing the barrier from being lifted when the vehicle is in contact with it.

While this device is intended to stop high powered vehicles, it provides no fortification other than the gate frame itself. Furthermore, since the barrier disclosed by Strauss includes a meshed cable gate, if the invention is combined with any standard gate, the effectiveness of the system may be compromised.

U.S. Pat. No. 2,023,538 to Orr et al. discloses a mechanically operated railway crossing barrier. This invention utilizes a resilient shock absorbing bumper at each end of the gate which extends partially across the gate. However, this bumper does not span the gate, nor will it function to prevent gate failure in case of a high powered vehicular impact. Rather, it serves to protect the gate from damage in case it is accidentally bumped by a vehicle. Also, the Orr gate is not fortified against, nor intended to withstand high speed vehicular impacts. Rather, it functions to warn vehicles and block railroad crossings.

U.S. Pat. No. 2,602,249 to Sawyer discloses a yieldable barrier. This barrier provides protection for traffic at movable bridge heads, grade crossings, ferries and the like. This invention concerns an improvement and simplification of the interlocking of the movable mechanism with the structural framing which encloses and supports this mechanism. This movable mechanism carries the snubbing devices for the flexible yielding network which encloses and supports this mechanism.

This device is very similar to that disclosed by Strauss (see above), and possesses several of the same disadvantages with respect to use as a security gate system. First, it may not accommodate standard gates without compromising the strength of the system. Moreover, other than the fortification inherent in the gate and frame, it includes no additional fortification.

U.S. Pat. No. 2,189,974 to Buford discloses a highway gate having a yieldable cable arrangement so that in the event of an impact against the gate, the gate will be allowed to move a predetermined distance so as to aid in resisting the impact. This reference also discloses a gate wherein weights must be lifted when the gate is moved laterally from its normal position so that raising these weights will oppose the lateral movement of the gate and assist in bringing the impacting vehicle to rest.

As with Strauss and Sawyer (see above), the Buford gate uses a cable arrangement which pays out when impacted. Again, however, use of standard gates with this system would compromise or negate its effectiveness. Also, it discloses no additional fortification other than the gate and gate frame.

U.S. Pat. No. to Butler discloses a gate mounted on a swinging mechanism by a break away mounting. When the gate is impacted, it breaks away from the swinging mechanism and impacts a set of cushions. This device exhibits the disadvantage that the gate is never captured by the cushions and, therefore, is free to move past the cushions if enough force is applied. Further, the system of Butler is only operational with impact in a single direction.

Thus, these references disclose gates or barriers intended to withstand vehicular impacts at varying speeds. These references fail to provide gates or barriers which may be combined with standard gate systems, and which possess additional fortification aside from the gate and gate frame itself. Furthermore, these references fail Lo provide gates or barriers which provide the above functionality regardless of the direction of impact, i.e., by a vehicle. The aforementioned references are hereby incorporated by reference.

SUMMARY OF THE INVENTION

The present invention provides a fortified gate which, if impacted (e.g. by a vehicle), automatically interconnects with anchors (e.g. precast concrete pillars) or other similar fortifying devices to provide an impenetrable barricade. The present invention may be combined with nearly any type of gate system such as vertical lift gates or horizontally sliding gates. Furthermore, it may be utilized alone or in combination with other deterrent gate systems (e.g. box frame gates or sallyport situations).

This system functions to thwart threats to secured areas by heavy objects such as vehicles or the like. When a gate is impacted, the gate absorbs the energy and transfers it to fortified anchors while simultaneously interlocking with those anchors by way of a locking device (e.g., a spring loaded locking pin). With the gate and anchors thus interlocked, the entire system functions as an energy absorbing, unitized system capable of limiting the encroaching object (e.g., vehicle) to a predetermined, acceptable distance.

Because the gate and anchors do not become interconnected until an instance of, for example, vehicular impact, the gate remains reasonably accessible to authorized entry (e.g., vehicles, pedestrians). In its closed position however, the gate remains ready for transition from a passive structure to an active structure by sudden interconnection with the anchors.

It is therefore an advantage of the present invention to provide a fortified gate system which automatically interconnects a gate with anchoring devices when the gate is impacted by an object such as a vehicle.

It is therefore a further advantage of the present invention to provide a fortified gate system which absorbs energy from impact (e.g. vehicular impact).

It is therefore a further advantage of the present invention to limit penetration of an encroaching object (e.g., vehicle) vehicle to a pre-determined distance.

It is therefore a further advantage of the present invention to provide a gate which is secure against attempted crashes to gain entry, but is still reasonably accessible.

It is therefore a further advantage of the present invention to provide a fortified gate system which may be constructed in accordance with a desired level of security to compensate for a projected level of inertial impact.

It is therefore a further advantage of the present invention to provide a gate system which may be retrofitted to existing gates.

In another general aspect in accordance with the present invention is provided a system for automatically locking a gate comprising a gate having a member, and at least one anchor including means, linearly movably positioned, for locking the member to the anchor when the gate is impacted. This aspect may further have anchors including two means for locking, one for impact in a first direction and another for impact in a second direction.

In yet another aspect in accordance with the present invention is provided a gate anchor comprising at least one gate member receiver, and at least one impact-triggered lock having a movable trigger member, wherein the impact-triggered lock locks a gate member to the gate anchor upon impact. This aspect may also have an anchor including two impact-triggered locks, one for impact in a first direction and another for impact in a second direction.

Accordingly, it is a further advantage of the present invention to provide a system for automatically locking a gate and a gate anchor that will lock the gate regardless of whether the gate is impacted in a first or a second direction.

The method for locking a gate in accordance with another aspect of the present invention includes the steps of: providing a locking mechanism with a detent, impacting the detent with the gate member, and lockingly engaging the locking mechanism to the gate member when the detent is impacted by the gate member. Further, the method may include the step of lockingly engaging regardless of whether the impact is in a first or a second direction.

It is therefore an advantage of this aspect to provide a method by which a gate may be locked regardless of whether the gate is impacted in a first or a second direction.

The foregoing and other features and advantages of the invention will be apparent from the following more particular description of preferred embodiments of the invention.

BRIEF DESCRIPTION OF THE DRAWINGS

These and other advantages of the present invention will become more apparent upon examination of the drawings wherein like numerals refer to like elements throughout.

DETAILED DESCRIPTION OF THE PREFERRED EMBODIMENTS

Although certain preferred embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of the preferred embodiment.

Figure 1:
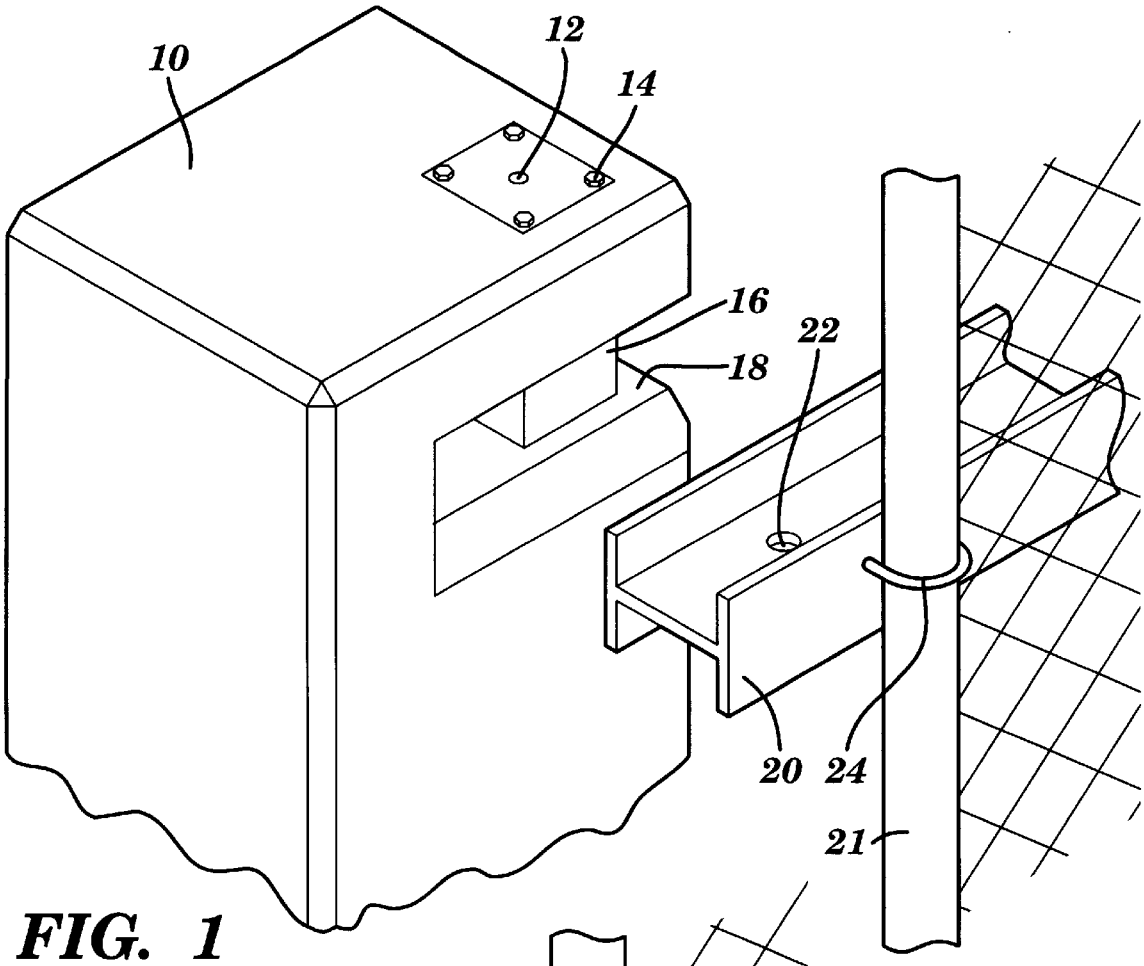
FIG. 1 is a top perspective view of a first preferred embodiment of the present invention showing the pre-impact relation of the brace to an anchor.
Figure 4:
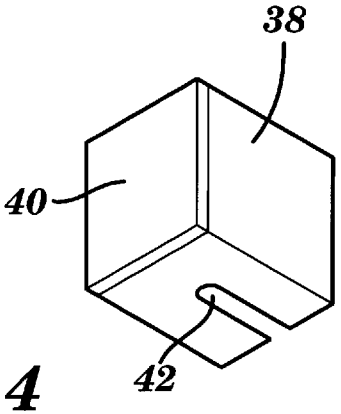
FIG. 4 is a bottom perspective view of a detent device of the present invention.

Referring to FIGS. 1 and 4, a precast concrete anchor 10 is shown in accordance with the first preferred embodiment of the invention. A brace 20 attached to a gate 21 by a steel ring 24 is shown in its pre-impact relation to the anchor 10, the receiving pocket 18 and the detent device 16. Although the brace 20 in this embodiment is a structural steel beam, numerous other structures could be used to brace a gate in this fashion. Furthermore, the term "brace" is herein defined as a member capable of receiving an impact, i.e., the brace need not necessarily be a member of the gate such that it adds structural strength to the gate itself. In other words, the brace may simply be a member attached to the gate or a gate in and of itself (i.e., a gate member).

A metallic plate 14 attached to the top of the precast concrete anchor 10 serves to stop the spring loaded locking pin 44 in the proper interconnecting position after it has been released. Furthermore, the metallic plate 14 provides a hole 12 for reloading the spring loaded locking pin 44 when desired.

Figure 2:
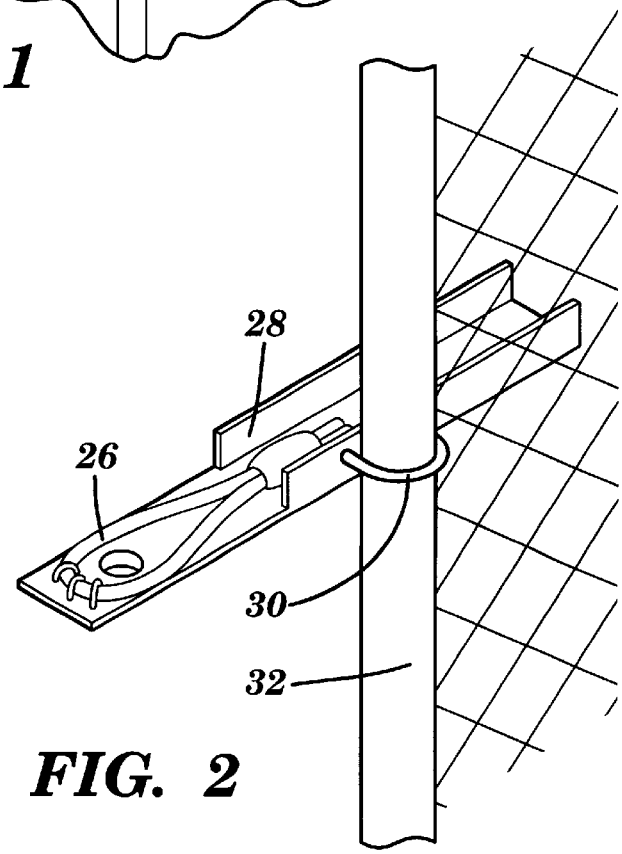
FIG. 2 is a top perspective view of a second preferred embodiment of the present invention showing the brace attached to the gate.

Referring to FIG. 2, a second preferred embodiment of a brace is shown including a longitudinal channel 28 housing a cable 26. As with the first preferred embodiment of the brace, this one is attached to the gate 32 with a steel ring 30 or other attachment device. This embodiment is particularly desirable for wider gates as cable is lighter weight and may be more readily accessible than structural steel beams.

Figure 3:
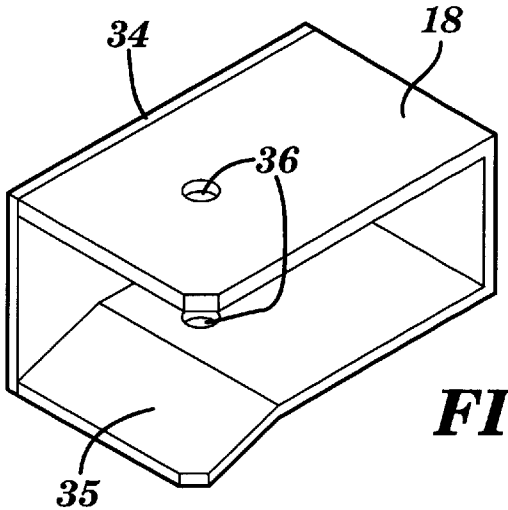
FIG. 3 is a top perspective view of a receiving device of in accordance with the first preferred embodiment of the present invention.

FIG. 3 depicts a receiving pocket 18 for one end of the gate. This pocket may be fashioned from plate steel or other similar materials. The slanted portion 35, is positioned to face the gate. Holes 36 in the top and bottom of the receiving pocket 18 exceed the diameter of the locking pin (not shown) in order to allow the locking pin to traverse these holes when it is released.

Referring to FIG. 4, the detent device 16 is shown in accordance with the first preferred embodiment of the invention. In a preferred embodiment this device will include a section of steel tubing 38 attached to a steel plate 40. A first channel 42 penetrates one side of the detent device 16, beginning opposite the steel plate and traversing approximately half the distance toward the steel plate. A second channel (not shown), exactly opposite the first channel 42, is an exact mirror image of the first channel 42. These channels are narrower in width than the diameter of the spring loaded locking pin.

Figure 5:
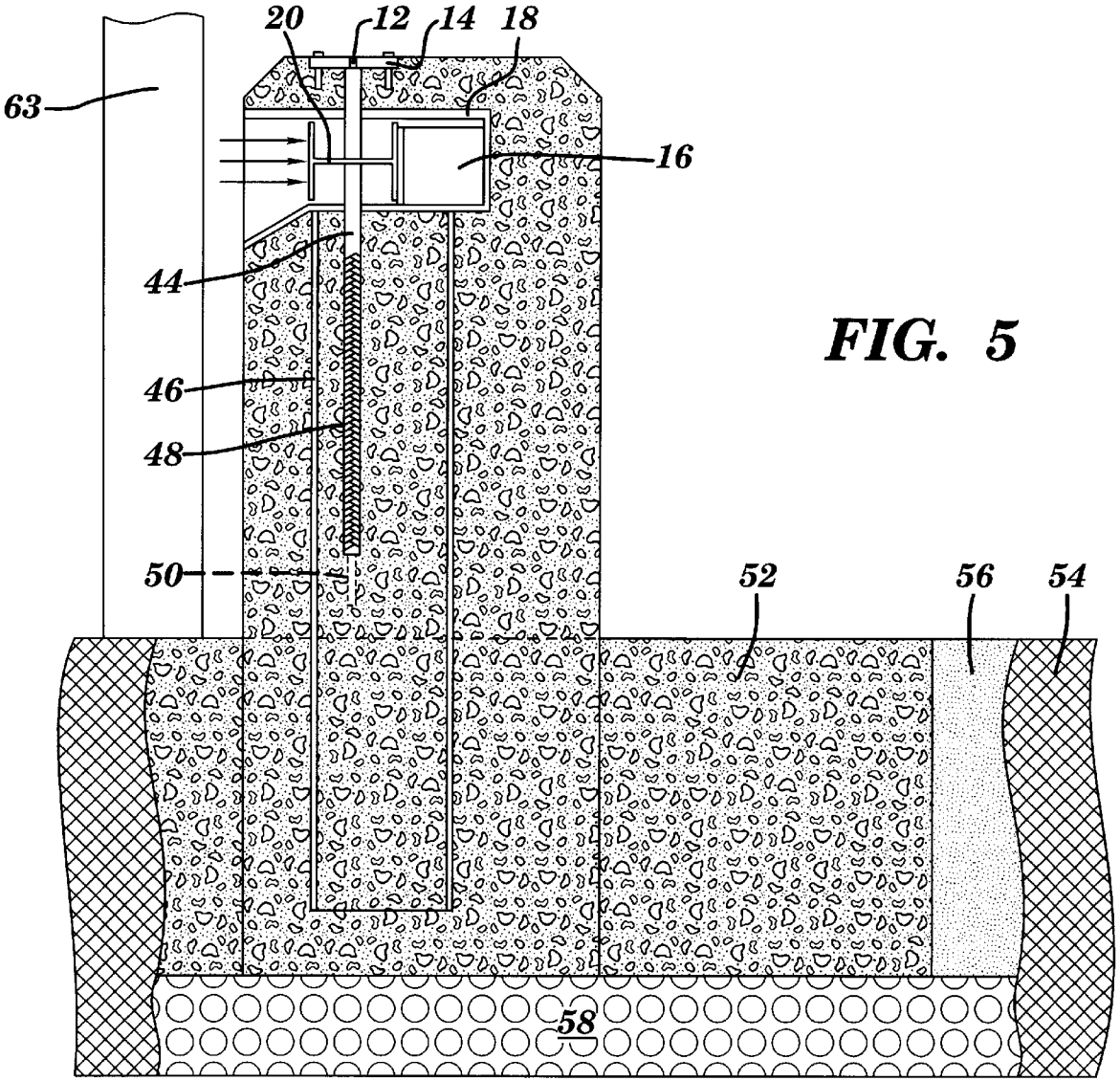
FIG. 5 is a side view of the first preferred embodiment of an anchor of the present invention showing the steel pin interconnecting the brace with the anchor.

Referring now to FIG. 5, when the gate is struck by a vehicle, it is forced backward, thus thrusting the brace 20 into the detent device 16. When the brace 20 impacts the detent device 16, the detent device 16 is pushed back further into receiving pocket 18 and the spring loaded locking pin 44 is released.

When it is released, the spring loaded locking pin 44 passes through hole 22 and is stopped by plate 14. Thus, the brace 20, precast concrete anchor 10, and receiving pocket 18 are interconnected by the locking pin 44 into a virtually immovable structure.

If desired, the locking pin 44 may be reloaded by following a series of steps. First, the metallic plate 14, locking pin 44, bracing means 20 and the detent device 16 are removed. Then, the locking pin 44 and the metallic plate 14 are replaced. At this point, a steel rod (not shown) with a diameter smaller than the hole 12 in the metallic plate 14 is used to force the locking pin downward, thus compressing spring 48. Finally, the detent device 16 is inserted into receiving pocket 18. The channels 42 pointed out in FIG. 4 (showing the detent device 16) allow the detent device to be pushed into place over the locking pin while the steel rod or other loading device holds the locking pin 44 in place. Since these channels are narrower than the diameter of the locking pin they hold the locking pin in a loaded position. The steel rod or other loading device is then removed, leaving the locking pin 44 in a loaded position.

In a preferred embodiment, the precast concrete anchor 10 includes a section of steel tubing 46 underneath the receiving pocket 18 and surrounding the spring 48 and locking pin 44. This embodiment also includes a weep hole 50 for draining rainwater, etc. from around the spring 48 and locking pin 44.

Also in a preferred embodiment, the precast concrete anchor 10 is fortified by a concrete block 52 which is placed behind the precast concrete anchor 10 and underneath the surface of the ground. The precast concrete anchor 10 and the concrete block are set on top of crushed stone 58. Remaining spaces between the undisturbed earth 54 and the precast concrete anchor 10 and concrete block 52 are filled in with backfill 56.

Figure 6:
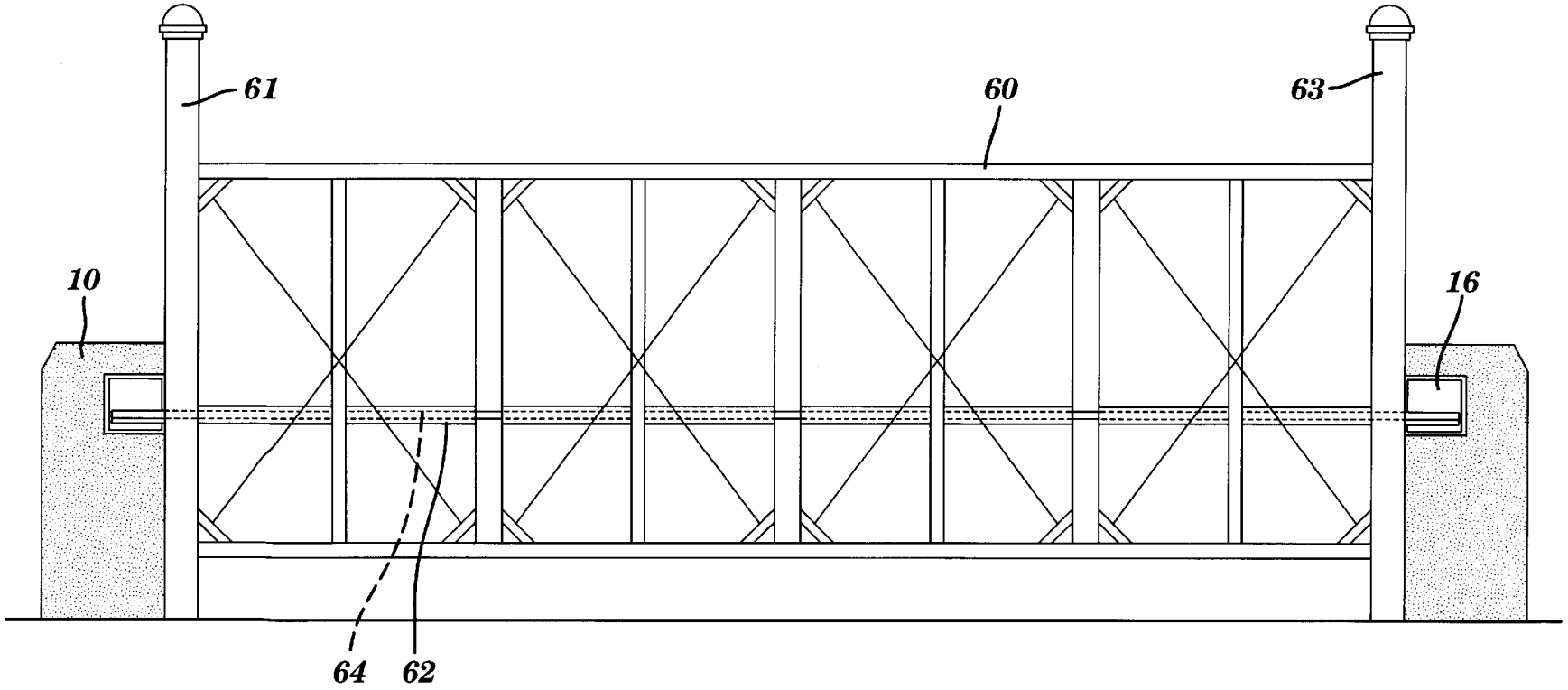
FIG. 6 is a front view of the first preferred embodiment of the present invention.

FIG. 6 depicts the entire gate system and locking mechanism in accordance with a preferred embodiment. The gate 60, may be constructed of chain link, rod iron, or any other materials known within the art. In this embodiment, the precast concrete anchors 10 are positioned behind the gate 60, and set apart at a distance roughly equivalent to the distance between the gateposts 61, 63. In this embodiment, the brace is a cable 64 housed in a channel member 62.

Both embodiments of the present invention may have various dimensions and utilize various materials depending upon the projected inertial impact and level of security desired in the gate system. This may be obtained by defining the mass of the object (e.g. vehicle) to be deterred, the velocity at which the object will be traveling at impact, and the allowable displacement distance upon impact. For example, the embodiment of FIG. 2 utilizes a cable which offers greater elasticity. However, greater penetration may be obtained against this embodiment than when using the embodiment of FIG. 1.

Figure 8:
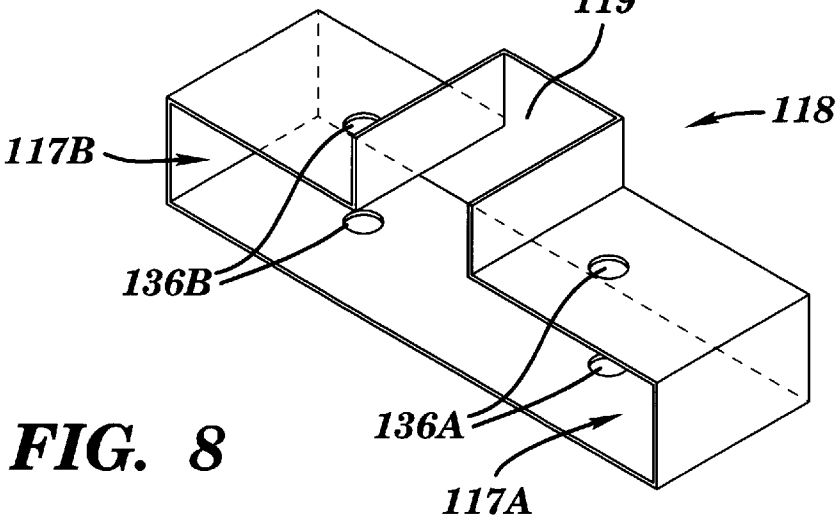
FIG. 8 is a perspective view of a receiving device of the third preferred embodiment of the present invention.
Figure 9:
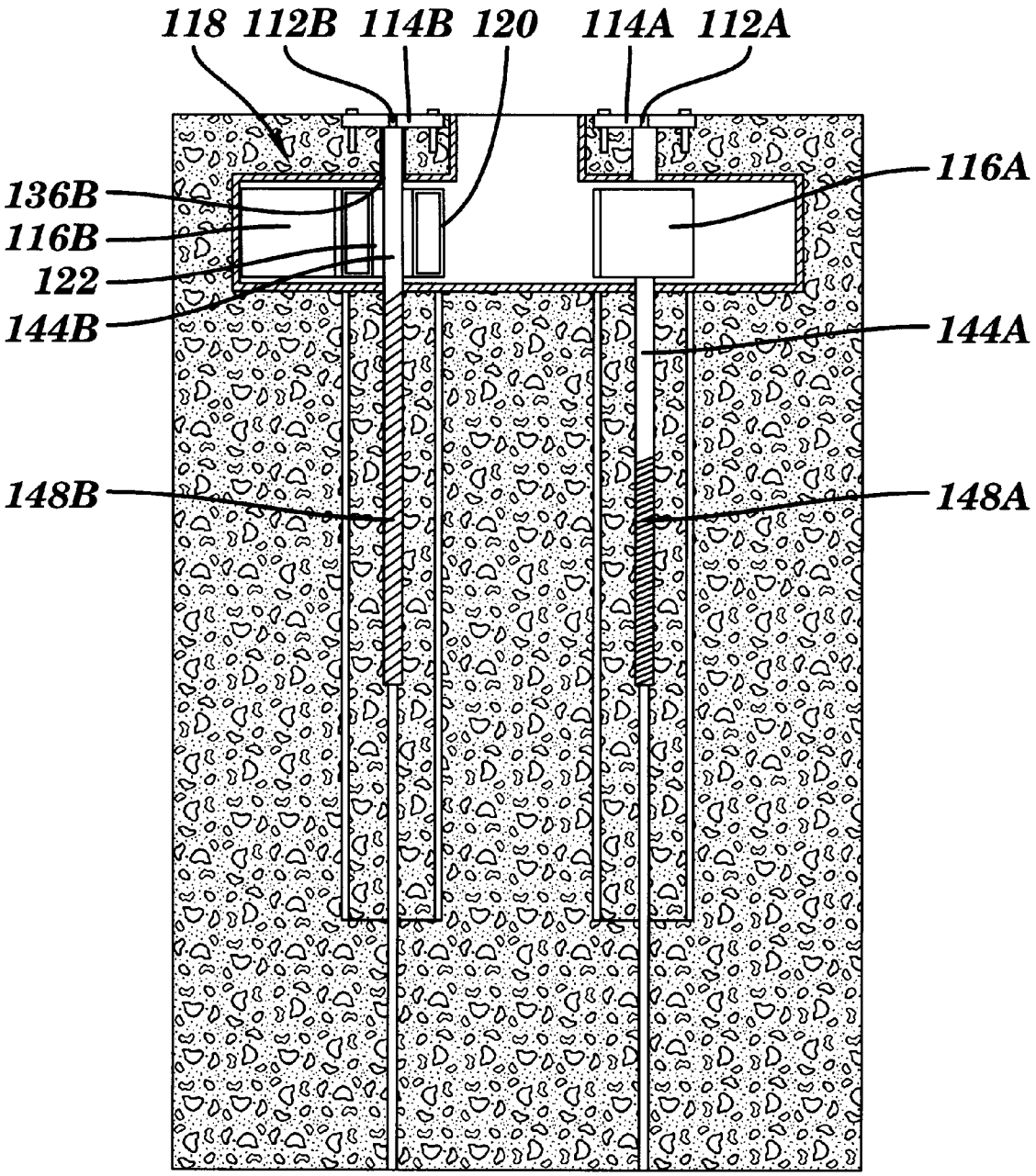
FIG. 9 is a side view of the third preferred embodiment of the anchor of the present invention after impact.
Figure 11:
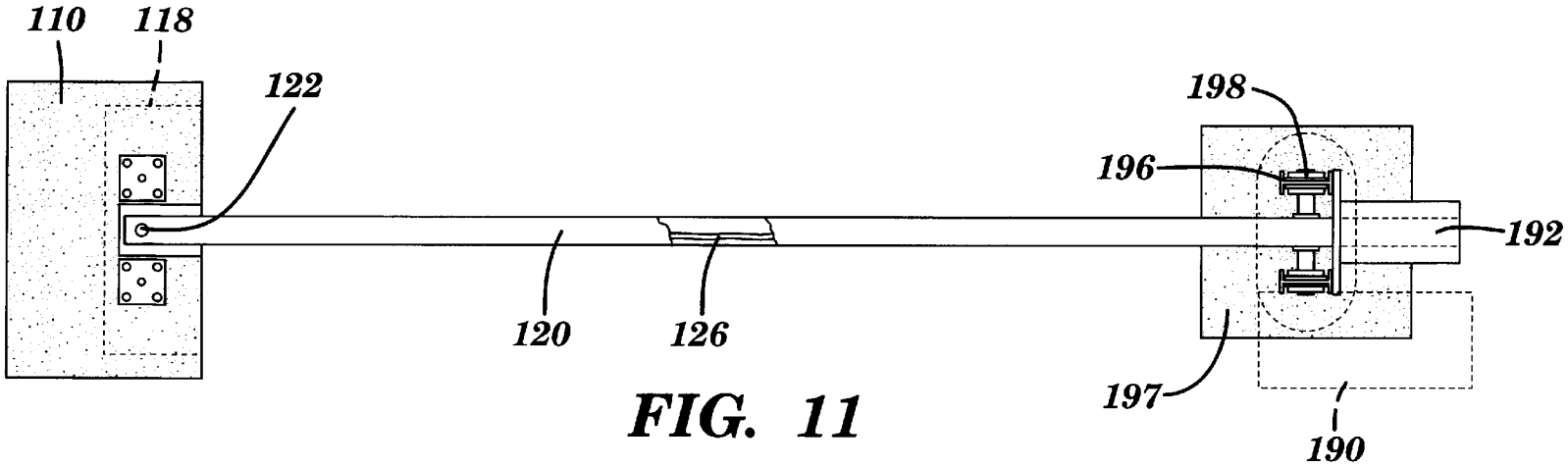
FIG. 11 is a plan view of the third preferred embodiment of the present invention.
Figure 10:
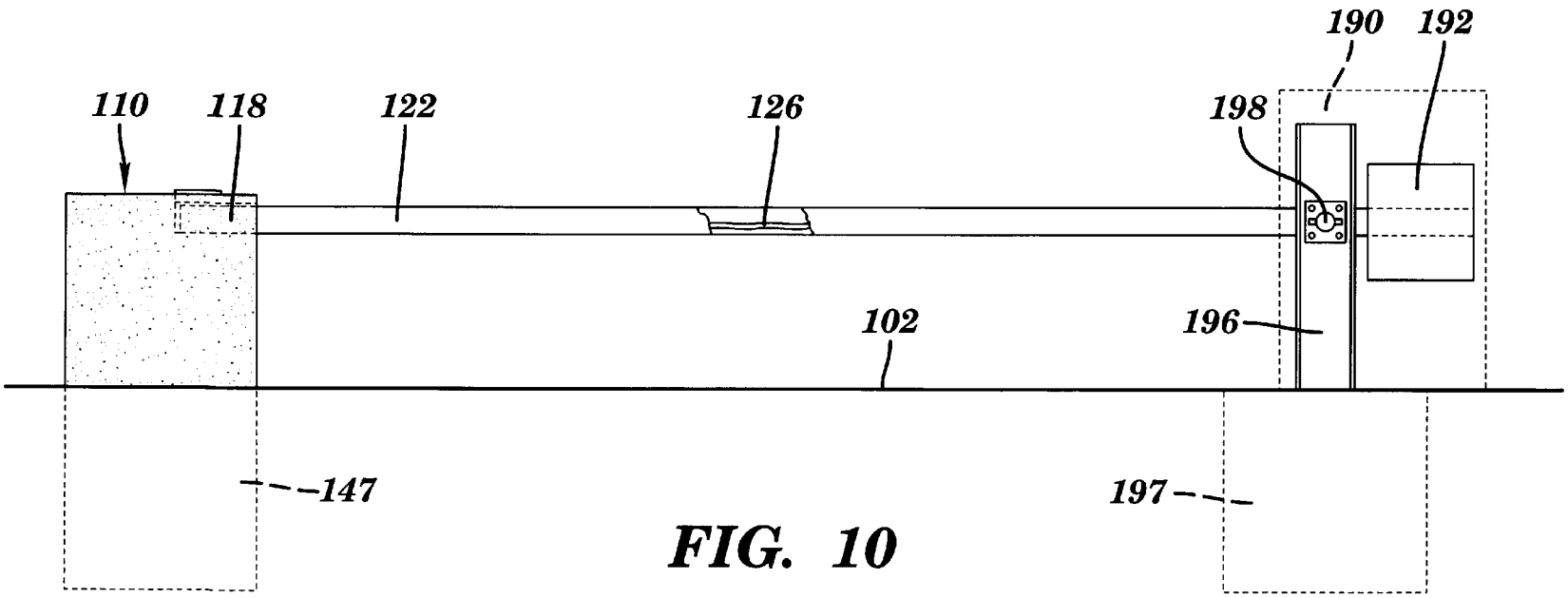
FIG. 10 is a front view of the third preferred embodiment of the present invention.

Referring now to FIGS. 7–11, a third preferred embodiment of the present invention is shown. As in the prior embodiments, a receiving pocket, detent device and spring loaded pin provide a means of locking the brace to the anchor upon impact of the brace, e.g., by a vehicle. However, in this embodiment a general duplication of components of the first embodiment to accommodate impacts in two directions is provided. In other words, the gate may be impacted from either of a first, inbound direction or second, outbound direction and still obtain automatic locking of the gate. Also, as shown in FIGS. 10 and 11, this embodiment uses a pivoting brace or member 120 as the gate member itself. The member 120 fits into the anchor 110 at one end and is pivotal about its second end via a horizontal axis 198 attached within a motor box 190 by a structural element 196. The member 120 is liftable in a conventional fashion by the use of a motor and counterbalance 192. The motor box 190 is anchored by a footing 197.

Figure 7:
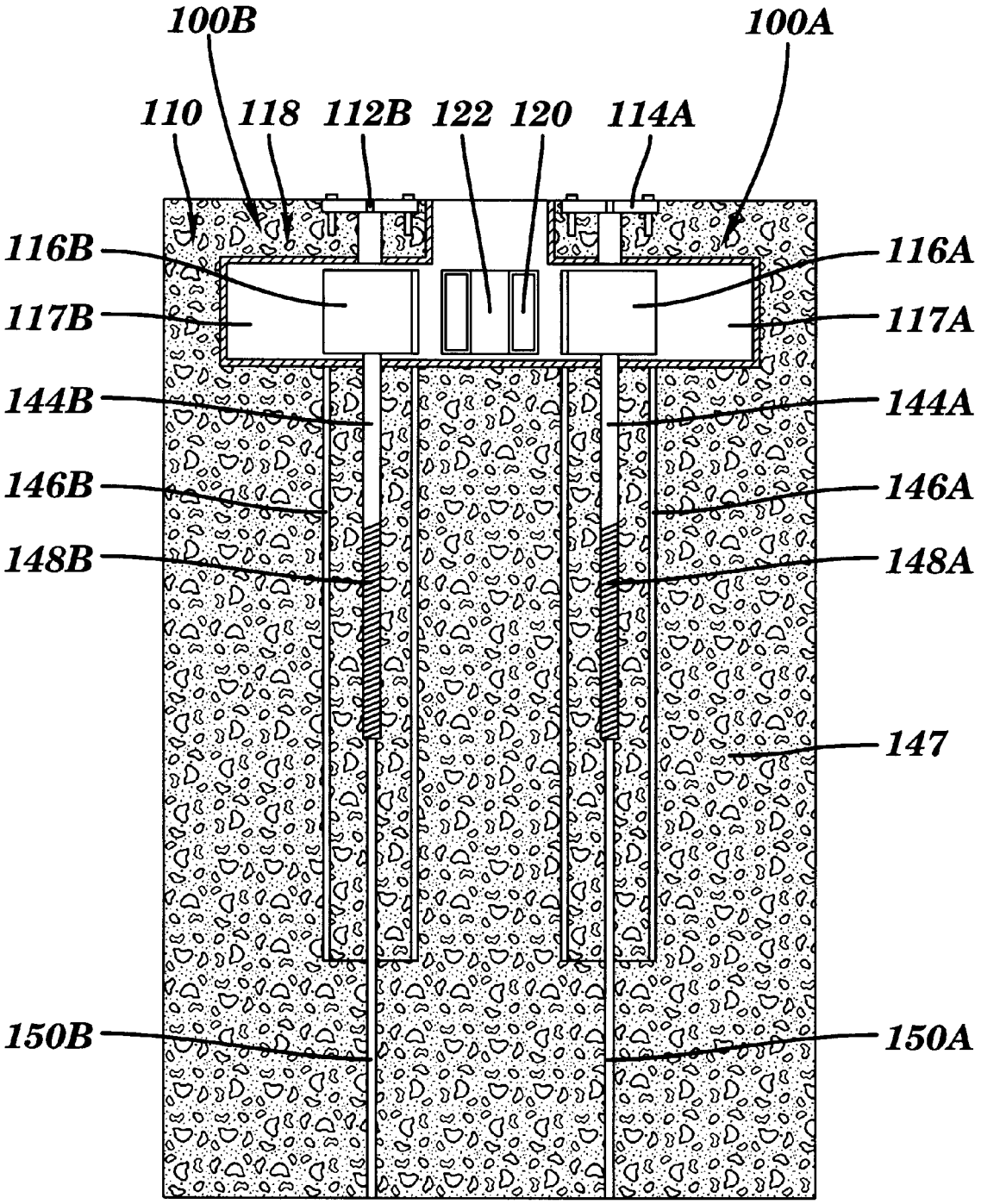
FIG. 7 is a side view of a third preferred embodiment of an anchor of the present invention prior to an impact.

In order to provide the dual direction impact function, an anchor 110, shown in FIGS. 7 and 9, includes a modified receiving device or pocket 118 which houses two impact triggered locks 100A, 100B. The modified pocket 118 includes a pair of side openings 117A, 117B, each housing a detent device 116A, 116B. As shown in FIG. 8, the pocket 118 generally is a five sided member with an opening 119 through which the member 120 passes. Holes 136A, 136B are provided in the top and bottom of the receiving pocket 118 on each side 117A, 117B. The holes 136A, 136B exceed the diameter of each of the respective locking pins 144A, 144B in order to allow the locking pin to traverse these holes when it is released. The pocket 118 may be fashioned from plate steel or other similar materials.

A metallic plate 114A, 114B is attached to the top of the precast concrete member 147 over each side 117A, 117B of the pocket 118 and serve to stop the spring loaded locking pins 144A, 144B in the proper interconnecting position after release. Furthermore, the metallic plates 114A, 114B provide holes 112A, 112B for reloading the spring loaded locking pins 144A, 144B when desired, as described above. The detent devices 116A, 116B are substantially similar to that described with regard to FIG. 4 and therefore will not be described in further detail except to state that the detents 116A, 116B face opposite directions in the pocket 118 to accommodate impact in either direction.

The concrete anchor 110 also includes steel tubing sections 146A, 146B underneath the receiving pocket 118 and surrounding each spring 148A, 148B and locking pin 144A, 144B. The anchor also includes weep hole 150A, 150B for draining rainwater, etc. from around the respective springs 148A, 148B and locking pins 144A, 144B.

Referring now to FIG. 9, when the member 120 is struck by a vehicle, it is forced backward, thus thrusting the member 120 into one of the detent devices 116A, 116B. As shown, detent device 116B has been impacted. When the member 120 impacts the detent device 116B, the detent device 116B is pushed back further into receiving pocket 118. As a result, the spring 148B is free to thrust the locking pin 144B upward. When the locking pin 144B is released, it passes through hole 122 in the member 120 and is stopped by plate 114B. Thus, the member 120, precast concrete anchor 110, and receiving pocket 118 are interconnected by the locking pin 144B into an immovable structure. The third embodiment, however, allows for locking of the member 120 regardless of whether the impact comes from either side of the gate, i.e., from a first, inbound direction or a second, outbound direction, because of the presence of the second impact triggered lock 100A. If desired, the locking pin 144A, 144B may be reloaded by following a series of steps as described with the first embodiment and not repeated here for brevity sake.

In the above examples, the member 120 is a structural steel tube with hole 122 provided by a hole or tube member extending perpendicularly through member 120. It should further be noted, however, that numerous other structures could be used for member 120. For instance, the member 120 could be an I-beam or C-channel structure, and could include cables 126 as described with regard to the first embodiment.

As with the first two embodiments, the third preferred embodiment may have various dimensions and utilize various materials depending upon the projected inertial impact and level of security desired in the gate system. This may be obtained by defining the mass of the object (e.g. vehicle) to be deterred, the velocity at which the object will be traveling at impact, and the allowable displacement distance upon impact.

The foregoing description of the preferred embodiments of this invention have been presented for purposes of illustration and description. It is not intended to be exhaustive or to limit the invention to the precise form disclosed, and obviously many modifications and variations are possible in light of the above teaching. Such modifications and variations that may be apparent to a person skilled in the art are intended to be included within the scope of this invention as defined by the accompanying claims.

We claim:

1. A system automatically locking an anchor having a pocket to a gate that defines an inside area and an outside area, the system comprising:

the gate having a member; and said anchor including means, movably positioned in a first direction or in a second direction opposite of said first direction within the pocket of the anchor, for locking through an aperture in the member to the anchor when the gate is impacted regardless of whether the impact is from the inside area or the outside area.

2. The system of claim 1, wherein the member spans the gate.

3. The system of claim 2, wherein the member further comprises a structural steel beam having an opening therein.

4. The system of claim 2, wherein the member further comprises a cable housed in a channel member.

5. The system of claim 1, wherein the at least one anchor includes a plurality of anchors that are positioned behind the gate.

6. The system of claim 1, wherein the at least one anchor further comprises concrete structures.

7. The system of claim 1, wherein the means for locking is positioned within the anchor.

8. The system of claim 1, wherein the means for locking further includes a spring loaded pin.

9. The system of claim 8, wherein the means for locking further includes a slidable detent which, upon impact by the member, releases the spring loaded pin to lock the member to the anchor.

10. The system of claim 9, wherein the anchor further includes a four sided pocket for receiving the slidable detent.

11. The system of claim 1, wherein the means for locking further includes a slidable detent which, upon impact by the member, releases a spring loaded pin to lock the member to the anchor.

12. The system of claim 11, wherein the anchor further includes a four sided pocket for receiving the slidable detent.

13. The system of claim 1, wherein the at least one anchor is a single anchor that includes two means for locking, one for impact from the inside area and another for impact from the outside area.

14. The system of claim 13, wherein each means for locking further includes a spring loaded pin.

15. The system of claim 14, wherein each means for locking further includes a slidable detent which, upon impact by the member, releases the spring loaded pin to lock the member to the anchor.

16. The system of claim 13, wherein the anchor further includes a five sided pocket for receiving the slidable detents.

17. The system of claim 13, wherein each means for locking further includes a slidable detent which, upon impact by the member, releases a spring loaded pin to lock the member to the anchor.

18. The system of claim 17, wherein the anchor further includes a five sided pocket for receiving the slidable detents.

19. The system of claim 1, wherein the gate is operatively coupled to a sliding structure.

20. The system of claim 1, wherein the member is operatively coupled to a pivoting structure.

21. The system of claim 1, wherein the means for locking is linearly movable.

22. A gate anchor and a gate member, comprising:

a base;

at least one gate member receiver within the base; and at least one preloaded impact-trigger movably connected to the base including a lock held from activation by a movable trigger member, wherein the lock is adapted to lock a gate member to the base upon impact of the movable trigger member by the gate member.

23. The gate anchor of claim 22, wherein the impact-triggered lock further comprises a spring loaded pin.

24. The gate anchor of claim 23, wherein the movable trigger member is a slidable detent which, upon impact by a gate member, releases the spring loaded pin to lock a gate member to the gate anchor.

25. The gate anchor of claim 22, wherein the movable trigger member is a slidable detent which, upon impact by a gate member, triggers locking of a gate member to the gate anchor.

26. The gate anchor of claim 22, wherein the anchor includes two impact-triggered locks, one for impact in a first direction and another for impact in a second direction.

27. The gate anchor of claim 26, wherein each impact-triggered lock includes a spring loaded pin.

28. The gate anchor of claim 27, wherein each impact-triggered lock further includes a slidable detent which, upon impact by a gate member, releases the spring loaded pin to lock a gate member to the gate anchor.

29. The gate anchor of claim 26, wherein each movable trigger member is a slidable detent which, upon impact by a gate member, triggers locking of a gate member to the gate anchor.

30. The gate anchor of claim 26, wherein the gate member receiver includes a pocket, constructed of steel plate, for receiving a gate member regardless of whether impact is in the first or second direction.

31. The gate anchor of claim 30, wherein the pocket includes five sides.

32. The gate anchor of claim 22, wherein the gate member receiver further includes at least one pocket composed of steel plate sized to receive a gate member.

33. The gate anchor of claim 32, wherein the pocket includes four sides.

34. The gate anchor of claim 22, wherein the base includes a concrete structure.

35. A method for locking a gate having a gate member comprising the steps of:

providing a locking mechanism with a detent;

impacting the detent with the gate member; and lockingly engaging the locking mechanism through the gate member when the detent is impacted by the gate member wherein the step of lockingly engaging the locking mechanism through the gate member when the dent is impacted by the gate member includes lockingly engaging regardless of whether the impact is in a first or a second direction.

36. The method of claim 35, wherein the step of providing further includes providing the locking mechanism in a fortified anchor.

37. The method of claim 35, wherein the step of providing further includes providing the locking mechanism with a spring loaded pin that is activated upon impact of the detent to pass through the gate member.

38. A system for automatically locking a gate comprising:

the gate having a member; and at least one anchor including a slidable detent and a spring loaded pin which, upon impact by the member, the slidable detent releases the spring loaded pin through an aperture in said member to lock the member to the anchor.

39. The system of claim 38, wherein the member further comprises a structural steel beam having an opening therein.

40. The system of claim 39, wherein the member further comprises a cable housed in a channel member.

41. The system of claim 38, wherein the at least one anchor includes a plurality of anchors that are positioned behind the gate.

42. The system of claim 38, wherein the at least one anchor further comprises concrete structures.

43. The system of claim 38, wherein the anchor further includes a four sided pocket for receiving the movable detent.

44. The system of claim 38, wherein the at least one anchor is a single anchor that includes the movable detent on each side of the member, each movable detent, upon impact by the member, releasing the spring loaded pin to lock the member to the anchor.

45. The system of claim 44, wherein the single anchor further includes a five sided pocket for receiving the movable detents.

46. The system of claim 38, wherein the gate is operatively coupled to a sliding structure.

47. The system of claim 38, wherein the member is operatively coupled to a pivoting structure.

* * * * *

UNITED STATES PATENT AND TRADEMARK OFFICE

CERTIFICATE OF CORRECTION

PATENT NO. : 5,987,816

DATED : November 23, 1999

INVENTOR(S) : Fischer et al.

It is certified that error appears in the above-identified patent and that said Letters Patent is hereby corrected as shown below:

Column 2, Line 21, insert "4,916,859" after No.

Signed and Sealed this

Eleventh Day of July, 2000

*Attest:*

Q. TODD DICKINSON

*Attesting Officer*

*Director of Patents and Trademarks*